US007559093B2

(12) United States Patent
Sudo et al.

(10) Patent No.: US 7,559,093 B2
(45) Date of Patent: Jul. 14, 2009

(54) BOTTOM CLOTHES

(75) Inventors: Mai Sudo, Kyoto (JP); Risa Saka, Kyoto (JP)

(73) Assignee: Wacoal Corp., Kyoto (JP)

( * ) Notice: Subject to any disclaimer, the term of this patent is extended or adjusted under 35 U.S.C. 154(b) by 0 days.

(21) Appl. No.: 11/909,831

(22) PCT Filed: Dec. 21, 2005

(86) PCT No.: PCT/JP2005/023500

§ 371 (c)(1),
(2), (4) Date: Sep. 27, 2007

(87) PCT Pub. No.: WO2006/126300

PCT Pub. Date: Nov. 30, 2006

(65) Prior Publication Data

US 2008/0194181 A1 Aug. 14, 2008

(30) Foreign Application Priority Data

May 27, 2005 (JP) ..... 2005-155721

(51) Int. Cl.
*A41D 13/00* (2006.01)

(52) U.S. Cl. ..... 2/69; 2/227; 272/119

(58) Field of Classification Search ..... 450/122–124, 450/130, 131, 151; 2/69, 228, 227, 238; 272/119

See application file for complete search history.

(56) References Cited

U.S. PATENT DOCUMENTS 3,894,542 A * 7/1975 Sacristan ..... 450/123
4,475,552 A 10/1984 Yoshihara et al.
4,698,847 A 10/1987 Yoshihara et al.
5,109,546 A * 5/1992 Dicker ..... 2/70
D402,786 S 12/1998 Fujii et al.
D404,538 S 1/1999 Fujii et al.
D404,889 S 2/1999 Fujii et al.
D412,610 S 8/1999 Fujii et al.
D412,772 S 8/1999 Fujii et al.
D413,008 S 8/1999 Fujii et al.
5,937,442 A 8/1999 Yamaguchi et al.
D420,781 S 2/2000 Fujii et al.
D424,280 S 5/2000 Fujii et al.
D427,750 S 7/2000 Fujii et al.

(Continued)

FOREIGN PATENT DOCUMENTS

JP 61239002 10/1986

(Continued)

*Primary Examiner*—Gloria Hale
(74) *Attorney, Agent, or Firm*—Darby & Darby P.C.

(57) ABSTRACT

According to the present girdle 1, when a wearer walks and a leg is moved backward, a forward load is applied to gluteus maximus muscle by a first tightening portion. Then, a reflective action of a muscle (muscle stimulation) to resist this load acts on the gluteus maximus muscle, and then the leg is moved further backward, resulting in a wearer's waist being twisted backward greatly. Further, a forward load is applied to elevated gluteus medius muscle by this backward waist twisting by a second tightening portion, resulting in the waist being twisted forward this time. Then, such a waist twisting motion is enhanced, which necessarily trains the wearer's groups of abdominal muscles, and a shape-up effect of the periphery of abdominal region may be obtained without the wearer performing intentional exercises.

6 Claims, 9 Drawing Sheets

U.S. PATENT DOCUMENTS

| | | | |
|---|---|---|---|
| 6,186,970 | B1 | 2/2001 | Fujii et al. |
| D481,523 | S | 11/2003 | Hujii et al. |
| D492,837 | S | 7/2004 | Hujii et al. |
| D495,469 | S | 9/2004 | Hujii et al. |
| 7,074,204 | B2 | 7/2006 | Fujii et al. |
| 2003/0028952 | A1 | 2/2003 | Fujii et al. |

FOREIGN PATENT DOCUMENTS

| | | | |
|---|---|---|---|
| JP | 5-77761 | B2 | 10/1993 |
| JP | 10-280209 | A | 10/1998 |
| JP | 2001-192903 | A | 7/2001 |
| JP | 2004-11055 | A | 1/2004 |
| KR | 2003-0060103 | A | 7/2003 |

* cited by examiner (a)

(b)

(a)

(b)

(a)

(b)

(b)

(a)

BOTTOM CLOTHES

CROSS REFERENCE TO RELATED APPLICATIONS

This is a U.S. national phase application under 35 U.S.C. §371 of International Patent Application No. PCT/JP2005/023500, filed Dec. 21, 2005 and claims the benefit of Japanese Application 2005-155721, filed May 27, 2005. The International Application was published in Japanese on Nov. 30, 2006 as International Publication No. WO 2006/126300 under PCT Article 21(2), the contents of which are incorporated herein in their entirety.

TECHNICAL FIELD

The present invention relates to bottom garment mainly for having function of shaping up the periphery of the abdominal region.

BACKGROUND ART

Conventionally, there is strong need to wish to make one's figure centered on the periphery of the abdominal region appear trim. As technologies to meet this need, for example, structure of clothes described in Japanese published examined application No. Hei 5-77761 may be listed. The conventional clothing structure is provided with stretchable portions which stretch in accordance with the stretching direction of muscles. When a wearer wearing this clothing performs an exercise, the stretchable portions act in a manner that restricts the muscles corresponding to body parts being exercised, thus attaining a shape-up effect of the body part.

Many people are interested in shaping up the periphery of the abdominal region. For example, awareness survey on 400 people's attitudes toward shape-up of the periphery of abdominal region conducted by the present application inventors presented results that: approximately 85% or more people answered "strongly desired" and "somewhat desired" to a question "Do you want to reduce your protruding abdominal region?" On the other hand, as for concrete measures for shape-up, answers like "taking care of eating" (54%), "performing abdominal and back muscle exercises" (37%) were obtained.

Here, intentional exercises such as the above-mentioned abdominal and back exercises have to be continuously performed to provide the shape-up effect. However, the situation is that even people having an interest in shape-up have difficulty performing the intentional exercises continuously. Taking such viewpoints into consideration, in conclusion, there is a problem with the above-mentioned conventional clothes that a wearer cannot obtain the effective shape-up effect if he/she does not do any intentional exercise continuously.

The present invention has been devised in order to solve the problem and aims at providing bottom garment giving a wearer a shape-up effect of the periphery of the abdominal region of the wearer without intentional exercises needed.

SUMMARY OF THE INVENTION

To solve the above-mentioned problem, the present application inventors have focused on "walking" which is indispensable to a routine motion, in the course of studying diligently. Further, they focused on the fact that a person has a habit of maintaining a center of gravity of body so as to hold a predetermined position by twisting his/her waist backward and forward when walking, and the waist twisting motion when walking is closely related to a motion of the groups of the abdominal muscles.

Here, conditions during exercise of a pelvis of a person walking on a treadmill will be shown in FIGS. 9(*a*) and 9(*b*). As shown in FIG. 9(*a*), a pelvis moves in a way that forms an oval trace assuming that a cross direction is a long axis, when viewed from a side (see an arrow "a"). Further, as shown in FIG. 9(*b*), the pelvis moves in a way that forms a horizontal number "8" trace, when viewed from a rear side (see an arrow "b"). Then, when a person is routinely walking, these traces formed by the pelvis are not so large, and it was revealed that a waist twisting motion and an accompanying motion of the groups of abdominal muscles is hardly produced. Then, the present application inventors obtained knowledge of how to provide support that enables a way of walking in which the pelvis forms large traces, namely a way of waking accompanied by a large waist twisting motion on a routine basis that will produce a shape-up effect of a wearer's periphery of abdominal region without requiring intentional exercises, and the inventors completed the present invention.

Bottom garment according to the present invention comprise a main body portion having stretching properties; and strip-shaped first and second tightening portions having stronger tightening force than that of the main body portion, which are arranged in pairs on the left-hand and right-hand sides of the main body portion, respectively, wherein the first tightening portions run from a wearer's crotch along the wearer's sulcus gluteus, pass a corresponding position just above the great trochanter, and extend to a proximity of a umbilicus, and the second tightening portions run from a proximity of the wearer's lumbar vertebrae along an upper part of gluteus maximus muscle to connect to the first tightening portions at a corresponding position just above the great trochanter.

In the bottom garment, when the wearer walks and the legs are moved backward, a forward load is applied to the gluteus maximus muscle by the first tightening portions. Then, a reflective action of a muscle (muscle stimulation) to resist this load acts on the gluteus maximus muscle, then legs are moved further backward, resulting in his/her waist being twisted backward greatly. Further, elevated gluteus medius muscle by this backward waist twisting, is applied forward load by the second tightening portions, resulting in the waist being twisted forward this time. Then, such a waist twisting motion is promoted, which necessarily trains the wearer's groups of abdominal muscles (especially, the oblique abdominal muscle). Therefore, in the present bottom garment, by giving importance on a routine motion like walking, the wearer can shape up the periphery of the abdominal region without performing intentional exercises.

Further, preferably, the first tightening portions and the second tightening portions have 2 to 7 cm width, respectively. By this configuration, a gluteal region may be tightly supported without impeding motion when walking, enabling them to suitably deliver load on the gluteus maximus and medius muscles. Additionally, the first tightening portions and the second tightening portions do not dig into a wearer's body, and good wear comfort is maintained.

Still further, preferably, at a corresponding position just above the great trochanter, an angle formed by the first tightening portions and the second tightening portions is 80 to 100 degrees. Such configuration may suitably deliver a load on the gluteus maximus and medius muscles.

Still further, preferably, the first tightening portions are connected to each other at the wearer's crotch and the second tightening portions are connected to each other at a position corresponding to the fourth lumbar vertebrae. By this configuration, the first tightening portions and the second tightening portions may be further tightly fitted to the gluteus maximus and medius muscles, enabling to further enhance the shape-up effect for the wearer.

Still further, preferably, the tightening force of the first tightening portions and the second tightening portions are 1.2 to 1.8 times as high as that of the main body. In this case, it is possible to apply a suitable amount of load on the gluteus maximus and medius muscles, maintaining wear comfort and easiness in walking.

Still further, preferably, the tightening force of the first tightening portions and the second tightening portions at the corresponding position just above the great trochanter is larger than those of other portions than the corresponding just above the great trochanter. In this case, it is possible to suitably deliver a load on the gluteus maximus and medius muscles, and further enhance the shape-up effect.

As described above, according to bottom garment of the present invention, a shape-up effect of a wearer's periphery of abdominal region may be obtained without his/her intentional exercises needed.

DETAILED DISCLOSURE OF THE INVENTION

Preferred embodiment of bottom garment according to the present invention will be hereunder explained in detail referring to accompanying drawings.

Figure 1:
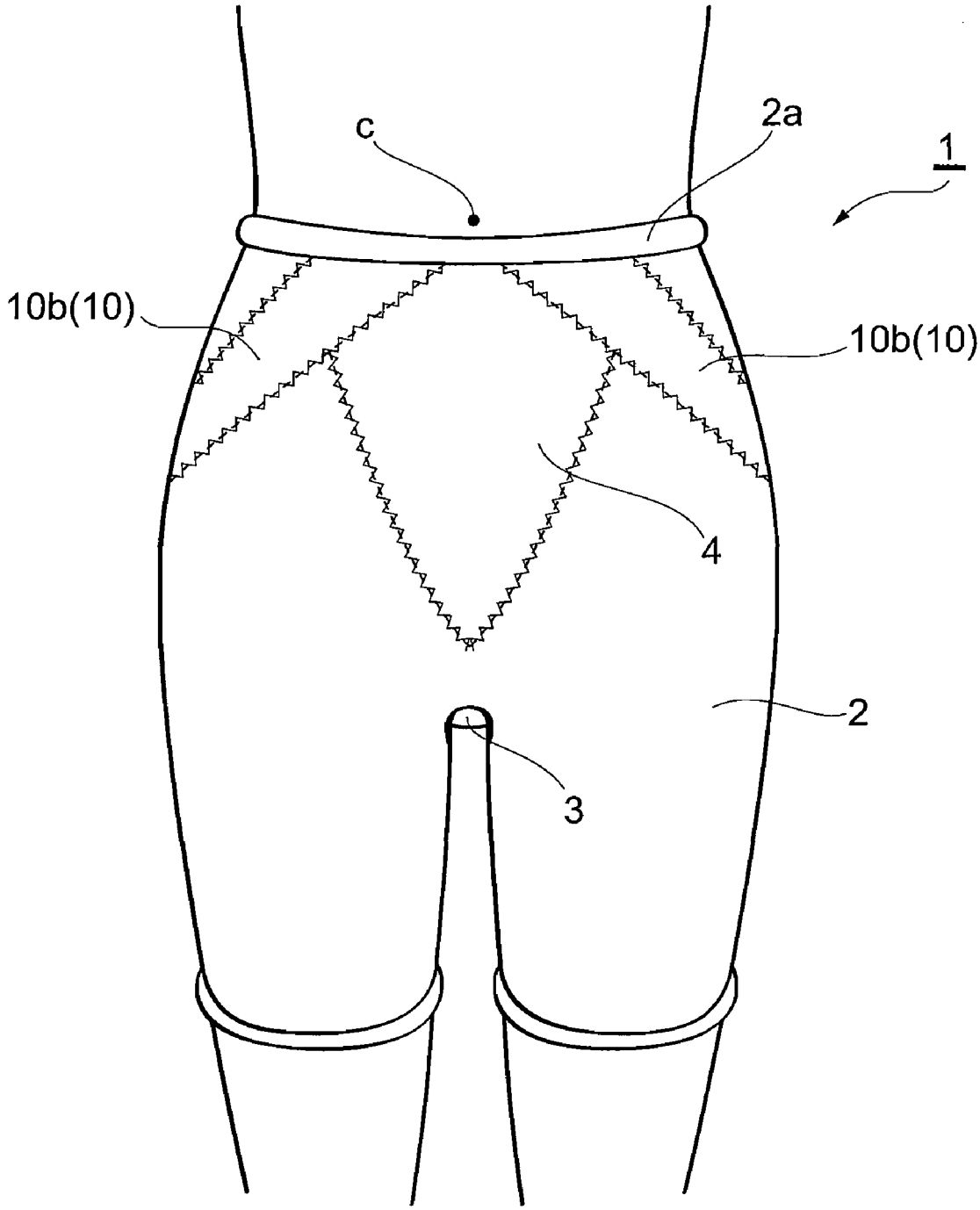
FIG. 1 is a front view showing a girdle which is one embodiment of bottom garment configured according to the present invention.
Figure 2:
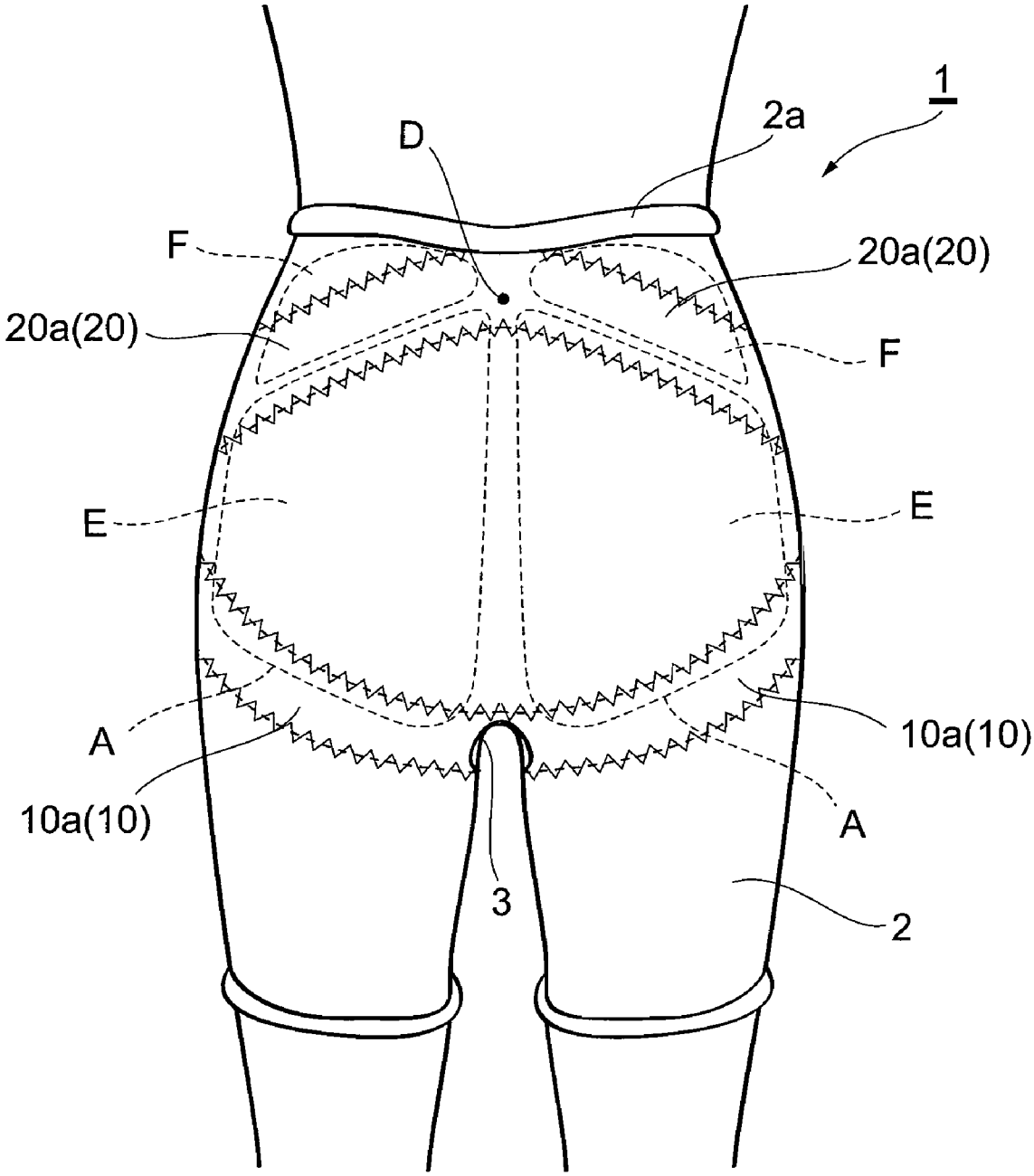
FIG. 2 is a rear view of a girdle shown in FIG. 1.
Figure 3:
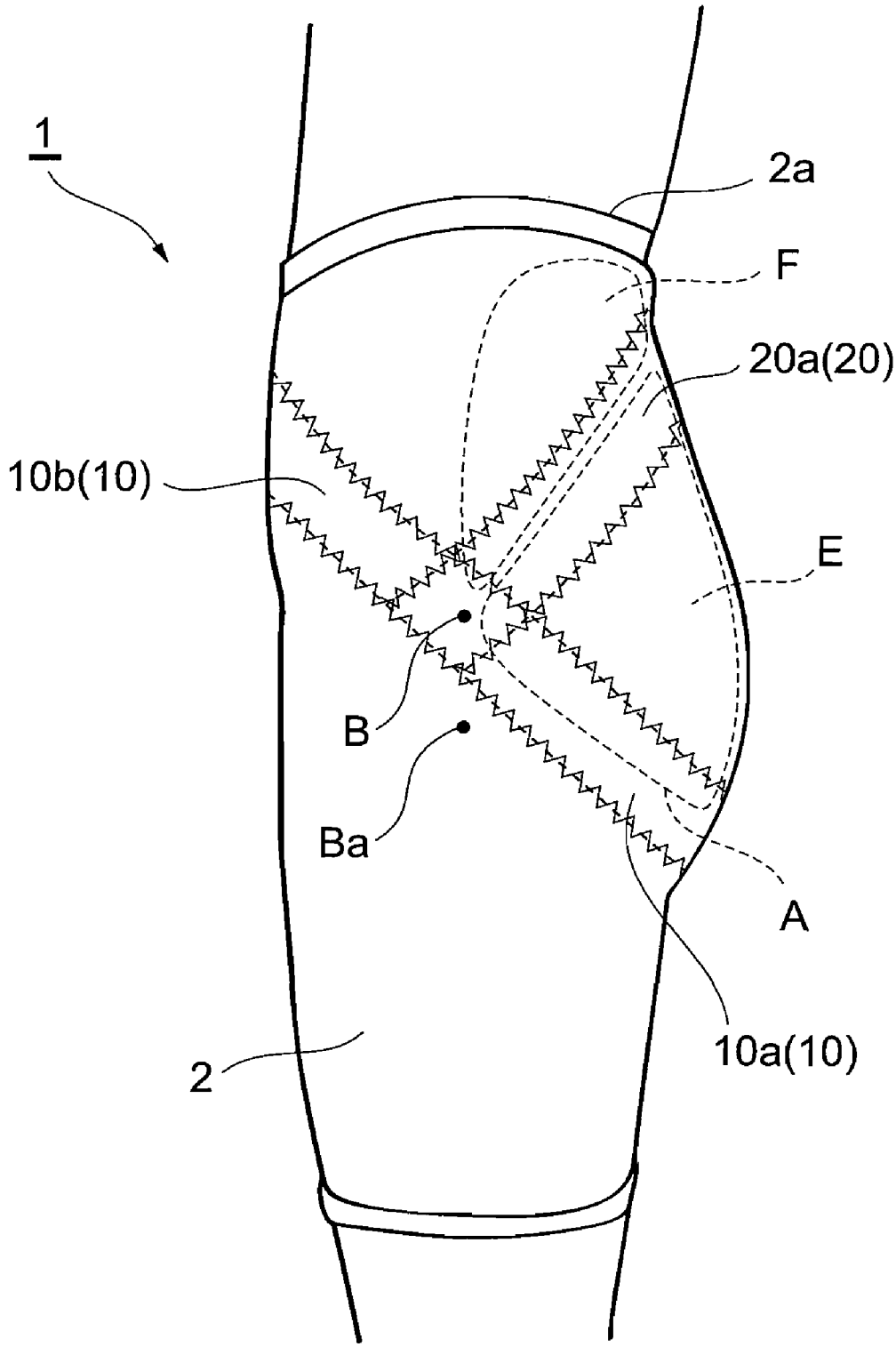
FIG. 3 is a side view of a girdle shown in FIG. 1.
Figure 4:
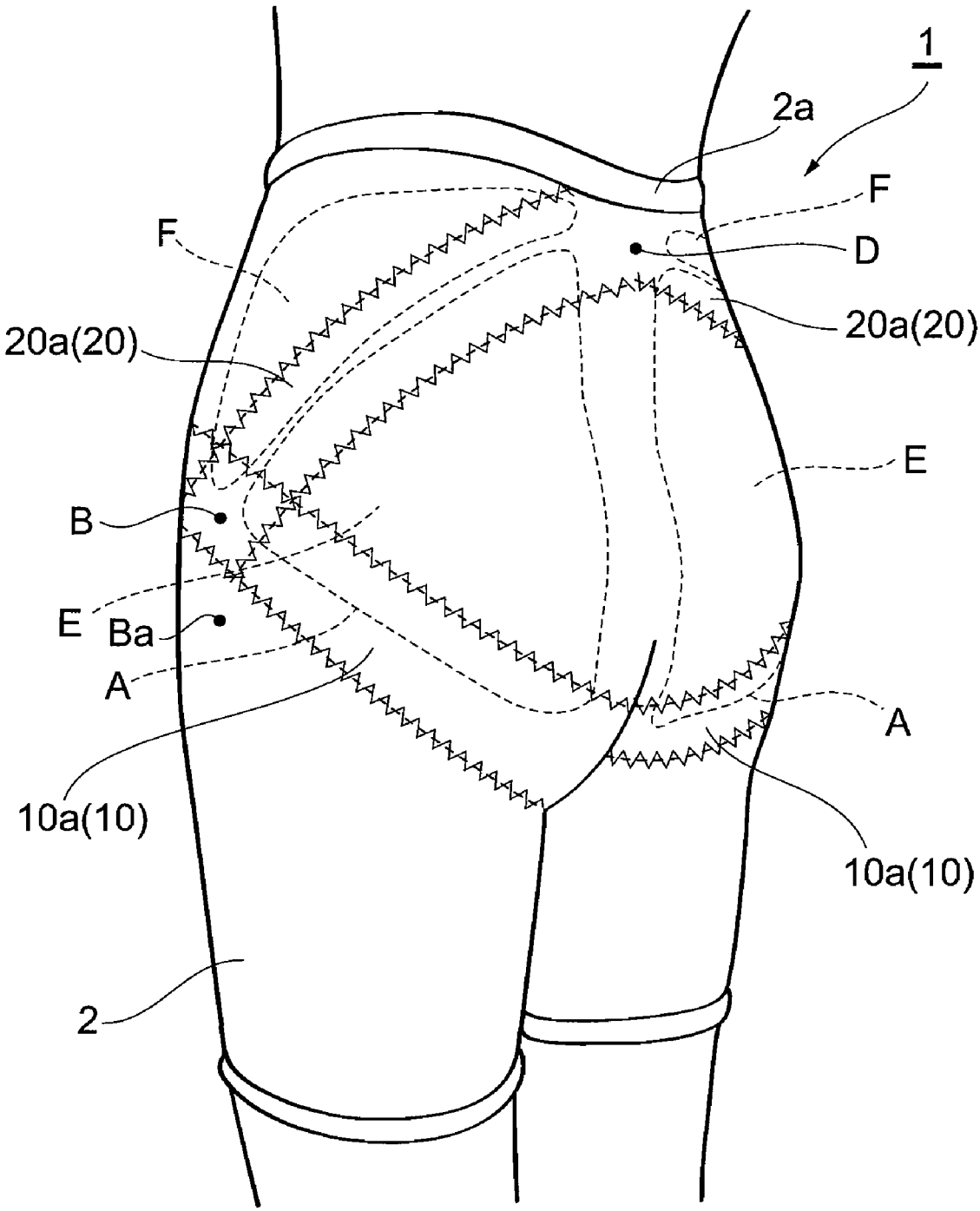
FIG. 4 is a perspective view of a girdle shown in FIG. 1, viewed from a rear side.

FIG. 1 is a front view showing a girdle which is one embodiment of the bottom garment configured according to the present invention, and FIG. 2 and FIG. 3 are a rear view and a side view, respectively. Further, FIG. 4 is a perspective view, viewed from a rear side. FIGS. 1 to 4 show a state in which a wearer is wearing the girdle. As shown in FIGS. 1 to 4, this girdle 1 is, as we say, a long-type girdle and comprises a girdle main body portion 2, a crotch portion 3, a filler cloth 4, first tightening portions 10, 10, and second tightening portions 20, 20, a hem of which ends above the wearer's knee. In addition, tightening portions in this case refer to portions composed of material more difficult to stretch than a material of the girdle main body portion, which provides stronger pressure than those of a periphery when worn.

The girdle main body portion 2 and the crotch portion 3 are made of stretch two-way Russell material (nylon 66 44T, polyurethane 285T, polyurethane 44T), and they are sewn together. In the girdle main body portion 2, left-hand and right-hand portions are sewn together at a midsection of a front side and a rear side to configure a front body and a back body, respectively. Further, in the waist part 2*a* of the girdle main body portion 2, a rubberized inside tape (not shown) is laced, ensuring a sense of fitness at the waist when worn. The filler cloth 4 is made of, for example, non-stretch plain net material mainly comprising nylon-polyurethane and formed into a diamond shape. The filler cloth 4 is sewn into a center of the front body of the girdle main body portion 2 which is placed on the wearer's lower abdomen.

The first tightening portions 10, 10 and the second tightening portions 20, 20 are arranged in pairs at left-hand and right-hand sides of the girdle main body portion 2, respectively. The first tightening portions 10, 10 and the second tightening portions 20, 20 are made of double plain net material (nylon 44T, polyurethane/cotton 470T/60T), having stronger tightening force than that of the girdle main body portion 2. Further, the first tightening portions 10, 10 and the second tightening portions 20, 20 are formed into a strip-like shape having an approximately 6 cm width, respectively, an edge of each of which is sewn into the girdle main body portion 2. The tightening force in this case refers to pressure received from the girdle when wearing.

Here, the first tightening portions 10, 10 are configured to connect to each other on a rear side of the crotch portion 3 which is placed at the wearer's crotch, extend obliquely upward along a lower edge of the gluteus maximus muscle E and an upper portion of a thigh centered on the sulcus gluteus A, and pass a corresponding position B just above the great trochanter. The corresponding position B just above the great trochanter falls on approximately 5 cm above a position corresponding to the great trochanter Ba along a body lateral line. Further, the first tightening portions 10, 10 extend from the corresponding position B just above the great trochanter obliquely upward on a flank, and elongates to an approximately midsection of the waist part 2*a* right under the umbilicus C. On the other hand, the second tightening portions 20, 20 are configured to connect to each other at a position D corresponding to the fourth lumbar vertebrae, extend obliquely downward along an upper edge of the gluteus maximus muscle E and gluteus medius muscle F from the position D. Then, the second tightening portions 20, 20 are overlapped with the first tightening portions 10, 10 in a manner that intersect at approximately a right angle at the corresponding position B just above the great trochanter. The first tightening portions 10, 10 and the second tightening portions 20, 20 like these may be formed by sewing them into the girdle main body portion 2, or gluing them to the girdle main body portion 2, or putting them as patches on the girdle main body portion 2. Alternatively, the first tightening portions 10, 10 and the second tightening portions 20, 20 may be formed by increasing knitting density of the girdle main body portion 2, or applying resin such as polyester or polyurethane to the girdle main body portion 2.

Next, power balance of the girdle 1 will be explained. In the present embodiment, the tightening force of the girdle main body portion 2 is about 2.9 kPa. On the other hand, the tightening force of the first tightening portions 10, 10 and the second tightening portions 20, 20 is about 1.3 to about 1.7 times higher than that of the girdle main body portion 2. More specifically, among the first tightening portions 10, 10, the tightening force of portions 10*a*, 10*a* along the sulcus gluteus A is about 3.9 kPa, and the tightening force of portions 10*b*, 10*b* along the flank is about 4.4 kPa. Further, among the second tightening portions 20, 20, the tightening force of portions 20*a*, 20*a* along the upper edge of the gluteus maximus muscle is about 4.4 kPa. Still further, among the first tightening portions 10, 10, and the second tightening portions 20, 20, the tightening force of the corresponding position B just above the great trochanter is the highest compared to those of other portions, namely about 4.9 kPa. In addition, each tightening force of the girdle main body portion 2, the first tightening portions 10, 10 and the second tightening portions 20, 20 was measured using a clothing pressure measuring device (manufactured by AMI Techno Co., Ltd., AMI3037-10). A method of measuring the tightening force may include attaching a pressure sensor to a measurement part of a dummy or a wearer to measure pressure placed on the pressure sensor by the girdle when worn.

Subsequently, a function of the above-configured girdle 1 when the wearer is walking while wearing the girdle 1, referring to FIGS. 5 and 6 will be explained.

Figure 5:
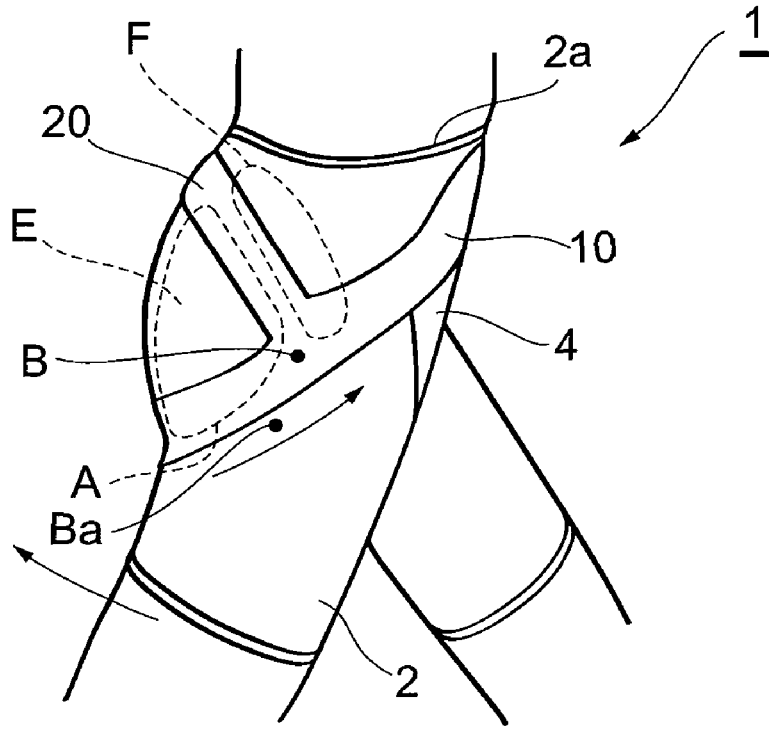
FIGS. 5(*a*) and 5(*b*) are drawings explaining a function of a girdle shown in FIG. 1.
Figure 5:
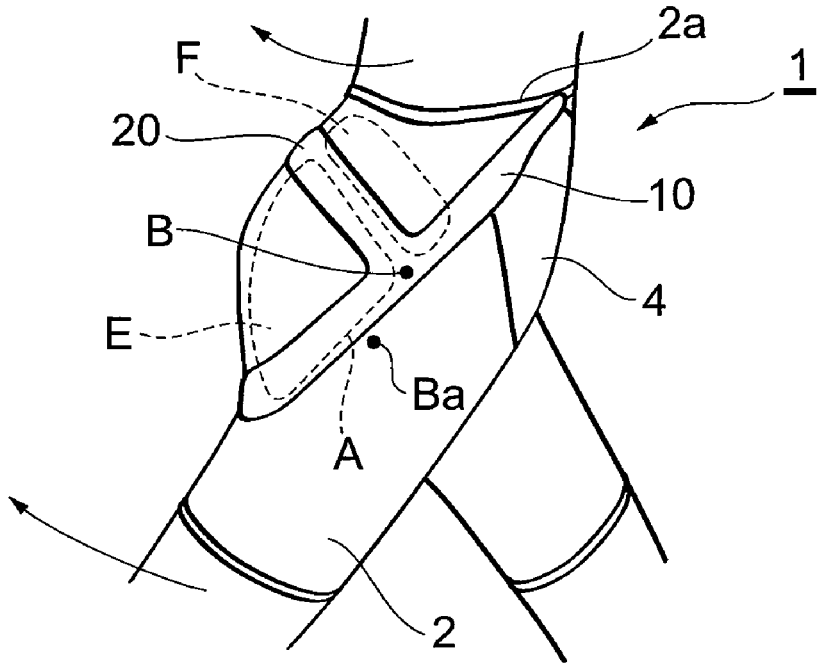

First, as shown in FIG. 5(*a*), when the wearer walks and a leg (here, a right leg) is moved backward, a forward load is applied to the gluteus maximus muscle E by the tightening force inherent within the first tightening portion 10. In this case, a reflective action of a muscle (muscle stimulation) to resist this load acts on the gluteus maximus muscle E to which the load is applied by the first tightening portion 10, and then the leg is moved further backward, resulting in the waist being twisted backward greatly, as shown in FIG. 5(*b*).

Figure 6:
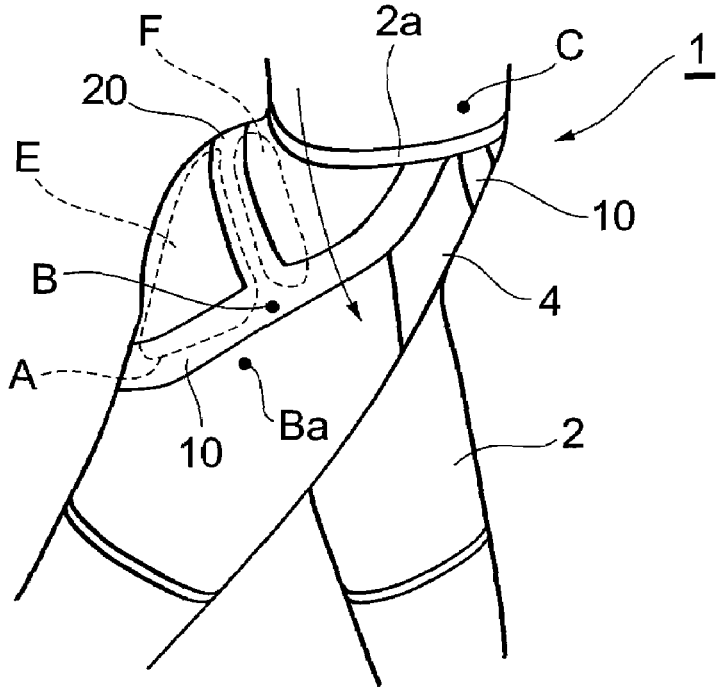
FIGS. 6(*a*) and 6(*b*) are drawings explaining a subsequent function of FIG. 5.
Figure 6:
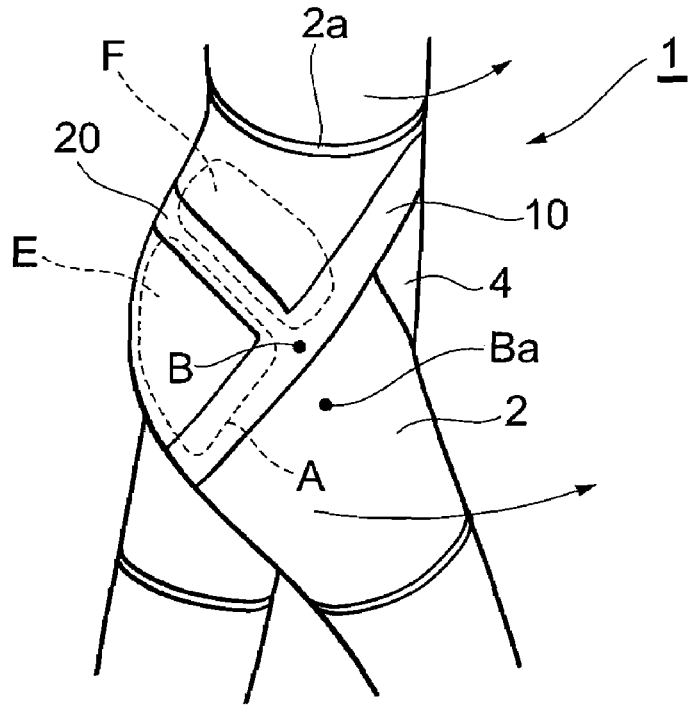

Further, as shown in FIG. 6(*a*), by twisting the waist backward greatly, the gluteus medius muscle F is elevated upward. Then, the tightening force inherent in the second tightening portion 20 applies a forward load to the elevated gluteus medius muscle F. By this load, as shown in FIG. 6(*b*), a motion when the leg is moved forward becomes large, resulting in the waist being twisted forward greatly this time. Subsequently, every time the leg is moved when walking, the same function occurs, and a waist twisting motion is repeated, which necessarily trains the wearer's groups of abdominal muscles. In addition, the oblique abdominal muscle among the groups of the abdominal muscles is a muscle directly linked to the waist twisting motion, and is not mainly used in daily life, and is thus effectively trained in a comparatively short time.

As described above, in the girdle 1 according to the present embodiment, by a function of the first tightening portions 10, 10 and the second tightening portions 20, 20, the waist twisting motion is given importance through a routine motion like walking, enabling the groups of the abdominal muscles to be trained unintentionally. Therefore, the wearer may obtain the effective shape-up effect of the periphery of an abdominal region without performing intentional exercise like abdominal and back muscle exercises.

Further, in the girdle 1, the first tightening portions 10, 10 and the second tightening portions 20, 20 are formed into a strip-like shape having an approximately 6 cm width. By this configuration, a gluteal region may be tightly supported without impeding motion when walking. Additionally, the first tightening portions 10, 10 and the second tightening portions 20, 20 hardly dig into the wearer's body, and good wear comfort is maintained. This effect may be preferably obtained if the width is within 2 cm to 7 cm.

The first tightening portions 10, 10 and the second tightening portions 20, 20 are connected in a manner that forms approximately a right angle at the corresponding position B just above the great trochanter. Further, the first tightening portions 10, 10 are connected to each other at the crotch portion 3 and the second tightening portions 20, 20 are connected to each other at a position D corresponding to the fourth lumbar vertebrae. By this configuration, the first tightening portions 10, 10 and the second tightening portions 20, 20 may be tightly fitted to the gluteus maximus muscle E and the gluteus medius muscle F, enabling to further promote the shape-up effect. In addition, even if an angle formed by the first tightening portions 10, 10 and the second tightening portions 20, 20 at the corresponding position B just above the great trochanter, is appropriately changed within 80 to 100 degrees, the same effect may be produced.

Further, as a power balance of the girdle 1, the tightening force of the first tightening portions 10, 10 and the second tightening portions 20, 20 is configured to be about 1.3 to 1.7 times as high as that of the girdle main body portion 2. Further, the tightening force at the corresponding position B just above the great trochanter in the first tightening portions 10, 10 and the second tightening portions 20, 20 is higher than those of portions 10*a*, 10*b*, 20*a* other than the corresponding position B just above the great trochanter by 0.5 kPa to 0.1 kPa. Such a power balance may provide the gluteus maximus muscle E and the gluteus medius muscle F with a preferably large load, maintaining wear comfort and easiness in walking. Even if the power balance varies within 1.2 to 1.8 times as high as the tightening force of the girdle main body portion 2, the same effect as the above-mentioned embodiment is produced.

Figure 7:
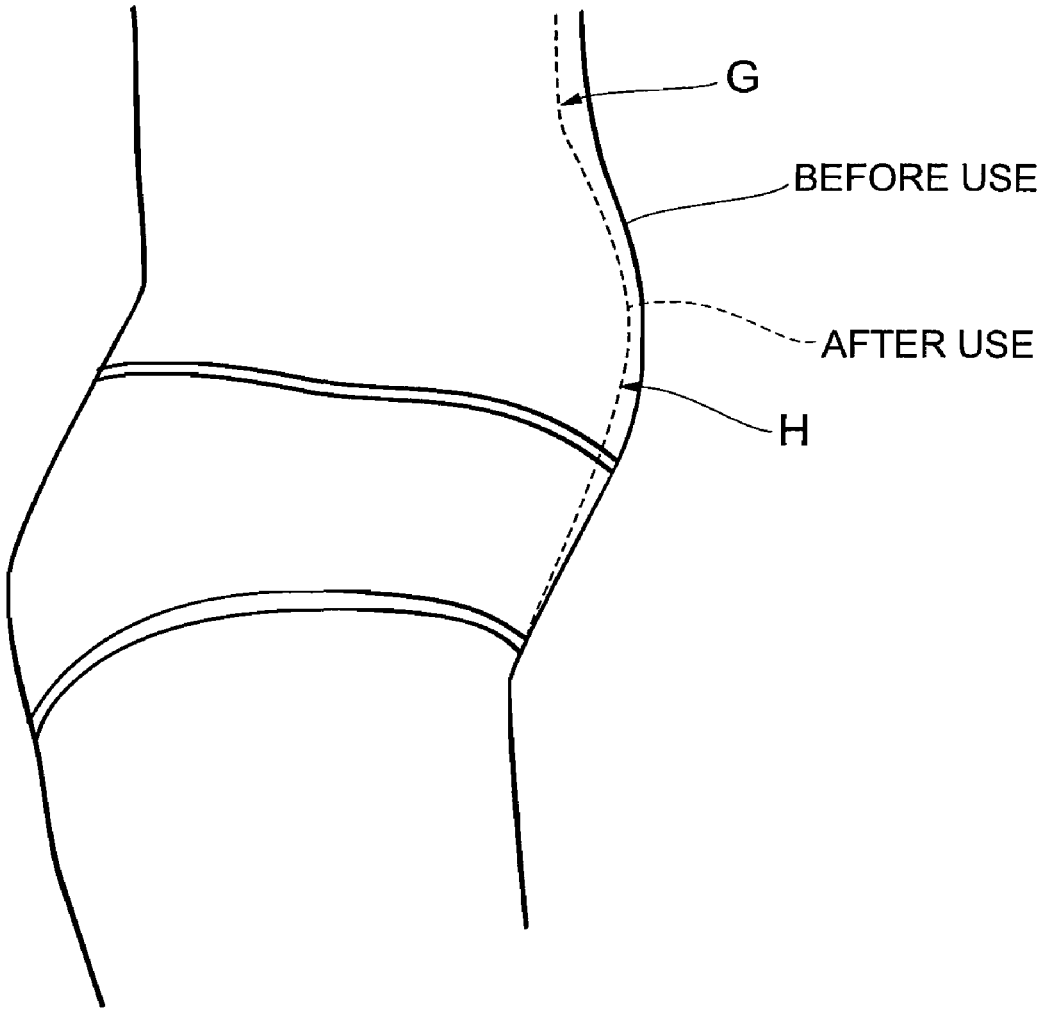
FIG. 7 is a drawing showing an abdominal region of an examinee who is subjected to a monitor test shown in FIG. 1.

Subsequently, results of monitoring test of the girdle 1 shown in FIGS. 1 to 4 will be explained. In this monitoring test, 10 examinees were made to wear samples having the same structure as that of the girdle 1 for one month, and the diameter G of the umbilicus circle and diameter H of a lower abdomen circle were measured, thereafter as shown in FIG. 7, to check whether a shape-up effect of the periphery of the abdominal region had been obtained or not. It was confirmed that the diameter G of the umbilicus circle of seven among ten examinees had been decreased by about 1.5 cm to 2.5 cm, and the diameter H of their lower abdomen circles by about 1.0 cm as results of this monitoring test. Further, as for comfort in wearing the girdle 1, answers of "easy to twist a waist" (seven among ten people), "was able to put power on an abdominal region" (six among ten people), "was able to walk stably" (nine among ten people), and "comfortable to wear" (nine among ten people) were obtained from examinees. In addition, two among the remaining three examinees gained weight due to their insufficient weight control during a monitoring period, so it could not be determined whether a shape-up effect on them was obtained or not.

Figure 8:
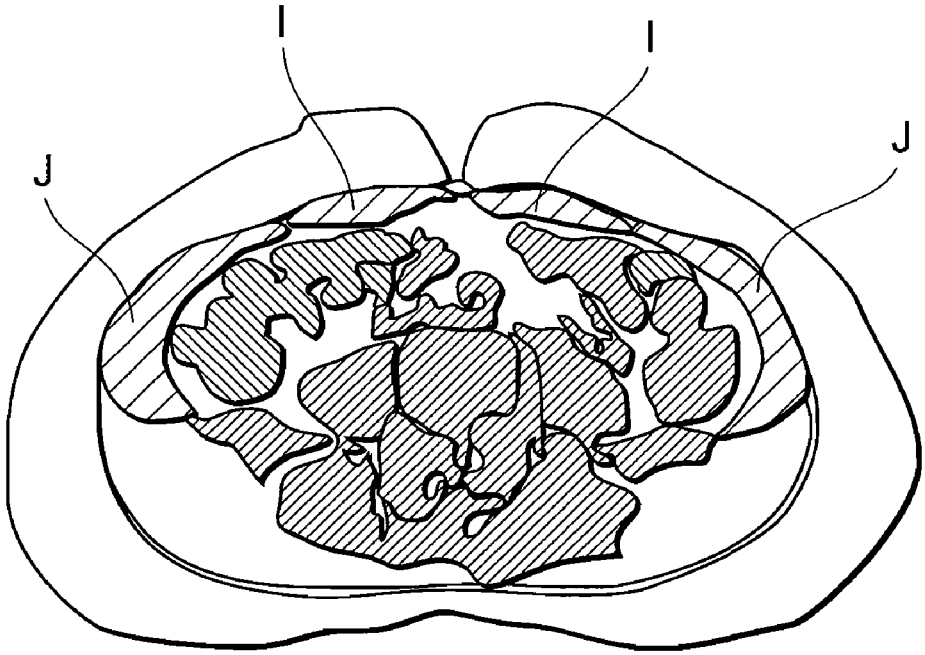
FIGS. 8(*a*) and 8(*b*) are drawings imaging a cross section of an abdominal region of an examinee shown in FIG. 7
Figure 8:
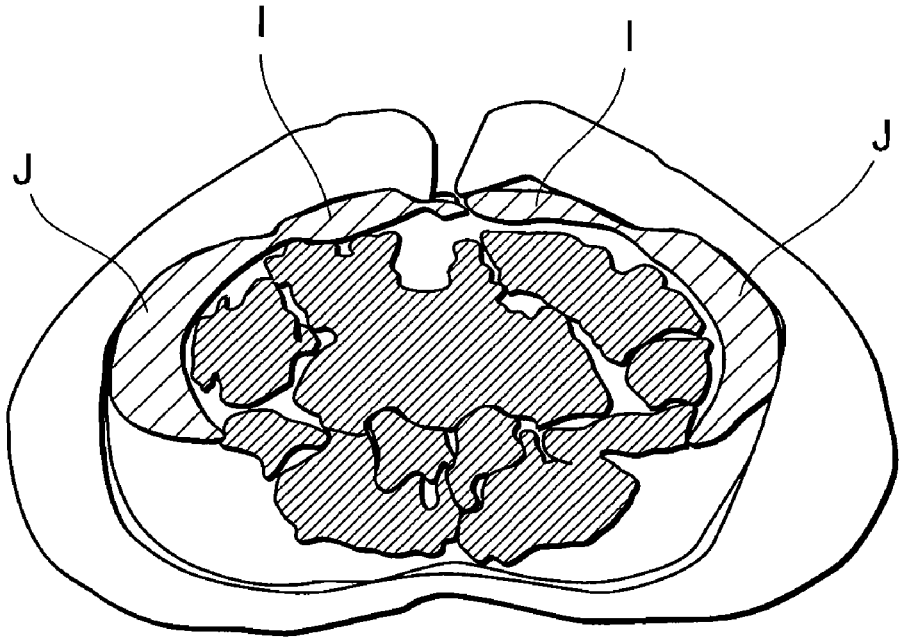
Figure 9:
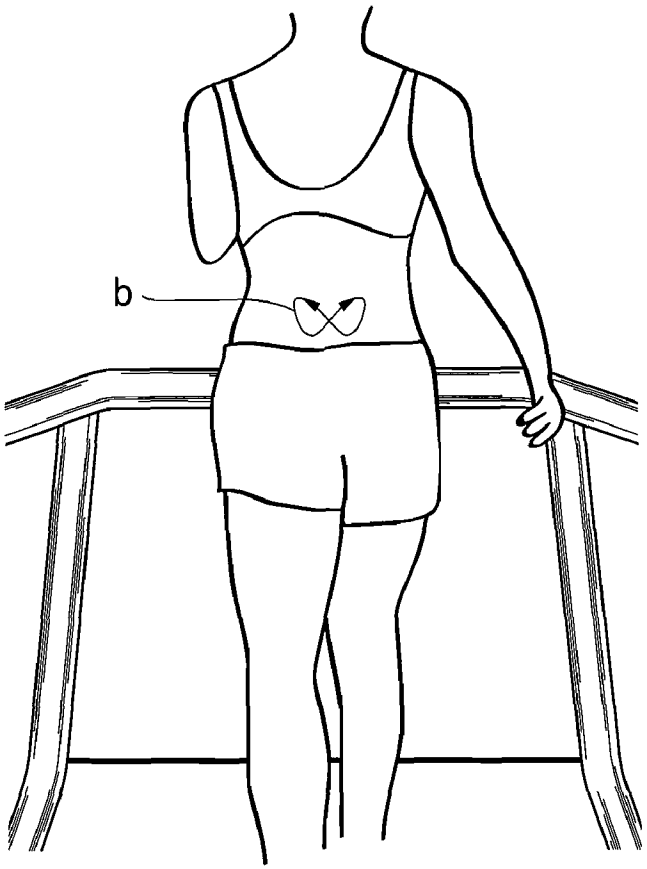
FIGS. 9(*a*) and 9(*b*) are a drawings showing conditions during exercise at a waist of a person walking on a treadmill.
Figure 9:
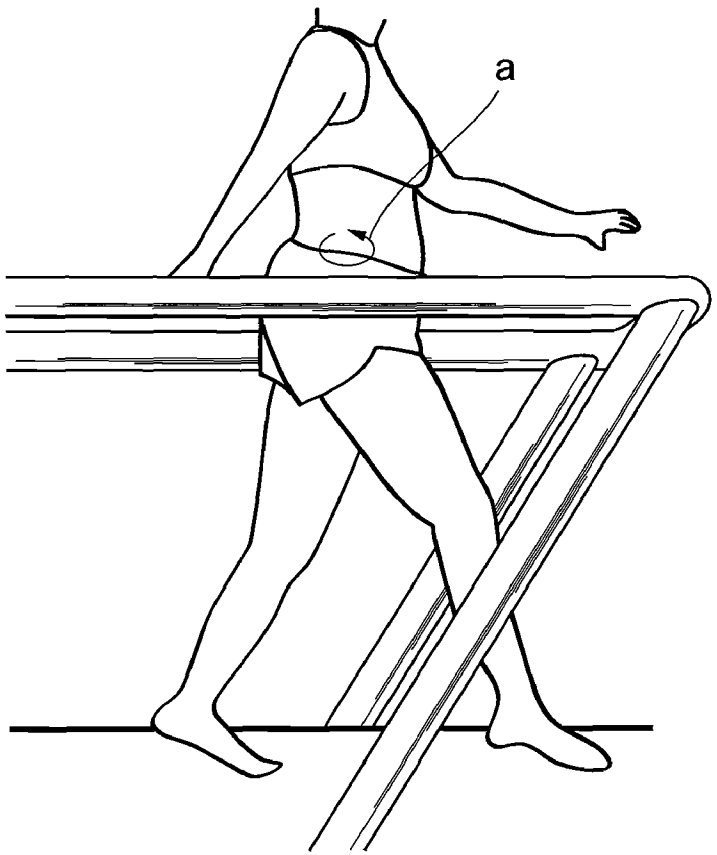

Results obtained by imaging via MRI (Magnetic Resonance Imaging System), a cross section near the umbilicus before and after use of the girdle 1 of each of the examinees on whom the shape-up effect was observed will be shown in FIGS. 8(*a*) and 8(*b*). In a cross section after use of the girdle 1 shown I FIG. 8(*b*), it could be confirmed that musculus rectus abdominis I and oblique abdominal muscle J constituting the groups of the abdominal muscles had been enhanced, compared to the cross section before use of the girdle 1 shown in FIG. 8(*a*). Specifically, the oblique abdominal muscle J had been remarkably enhanced, and thereby, subcutaneous fat at the periphery of the abdominal region had been raised and an outer line had been simply tightened.

Further, as for the power balance of the girdle main body portion 2 with the first tightening portion 10 and the second tightening portion 20, the present inventors made samples according to various comparative examples to examine the shape-up effect. First, as for each tightening portion 10, 20, they prepared three kinds of materials in total: single plain net material (nylon 44T, polyurethane/cotton 470T/60T: middle tightening force) and two-way Russell material (nylon 66 44T, polyurethane/cotton 470T/60T: weak tightening force) in addition to the double plain net material used in the girdle 1 (strong tightening force). Still further, as for the girdle main body portion 2 also, they prepared three kinds of materials in total: two-way Russell material difficult to stretch (nylon 66 44T, polyurethane 44T, polyurethane 78T), and two-way Russell material which is more stretchable than the former, in addition to the girdle main body portion 2 shown in FIG. 1. Then, they examined whether nine kinds of girdle samples in total configured by combining them produce a shape-up effect or not. As a result, a tendency that a higher shape-up effect may be obtained by stronger tightening force of each tightening portion 10, 20, had been confirmed.

Based on the above-mentioned effect, it has been demonstrated that in the girdle 1 according to the present embodiment, by a function of the first tightening portions 10, 10 and the second tightening portions 20, 20, a waist twisting motion as a routine motion like walking is preferably emphasized and an effective shape-up effect at the periphery of the abdominal region may be obtained. Further, it has been demonstrated that the girdle 1 is excellent from the standpoint of wear comfort and easiness in walking, and specified not to give a sense of discomfort for a continuous wearing.

In addition, the present invention is not limited to the above-described embodiment. For example, from the standpoint of obtaining a shape-up effect, a filler cloth 4 need not necessarily be provided. Further, in the above-described embodiment, although a girdle has been exemplified as one of bottom garment, the present invention may be applied to bottom garment other than a girdle. For example it may be applied to spats, tights, a supporter, a garter belt.

The invention claimed is:

1. A bottom garment comprising:

a main body portion having stretching properties; and strip-shaped first, second, third and fourth tightening portions having stronger tightening force than the tightening force of the main body portion;

wherein, in a rear view of a wearer's body in which the wearer is properly wearing the bottom garment, the first and fourth tightening portions are located on the left-hand side of the main body portion and the second and third tightening portions are located on the right-hand side of the main body portion;

wherein the first tightening portion runs from the wearer's crotch along the wearer's left sulcus gluteus, past a corresponding position just above the wearer's left great trochanter, and extends obliquely upward to a proximity of the wearer's umbilicus;

wherein the second tightening portion runs from the wearer's crotch along the wearer's right sulcus gluteus, past a corresponding position just above the wearer's right great trochanter, and extends obliquely upward to a proximity of the wearer's umbilicus;

wherein the third tightening portion runs obliquely downward from a proximity of the wearer's lumbar vertebrae along an upper part of the wearer's right gluteus maximus muscle to connect to the second tightening portion at a corresponding position just above the right great trochanter; and wherein the fourth tightening portion runs obliquely downward from a proximity of the wearer's lumbar vertebrae along an upper part of the wearer's left gluteus maximus muscle to connect to the first tightening portion at a corresponding position just above the left great trochanter.

2. The bottom garment according to claim 1, wherein the first, second third and fourth tightening portions all have 2 to 7 cm width.

3. The bottom garment according to claim 1, wherein at the corresponding position just above the wearer's left great trochanter, an angle formed by the connection between the first and fourth tightening portions is 80 to 100 degrees and wherein at the corresponding position just above the wearer's right great trochanter, an angle formed by the connection between the second and third tightening portions is 80 to 100 degrees.

4. The bottom garment according to claim 1, wherein the first and second tightening portions are connected to each other at the wearer's crotch and the third and fourth tightening portions are connected to each other at a position corresponding to the wearer's fourth lumbar vertebra.

5. The bottom garment according to claim 1, wherein the tightening forces of the first, second, third and fourth tightening portions are 1.2 to 1.8 times as high as the tightening force of the main body portion.

6. The bottom garment according to claim 1, wherein:

the tightening forces of the first and fourth tightening portions at the corresponding position just above the left great trochanter are larger than the tightening forces of the first and fourth tightening portions at other positions; and the tightening forces of the second and third tightening portions at the corresponding position just above the right great trochanter are larger than the tightening forces of the second and third tightening portions at other positions.

* * * * *